US006762780B2

(12) United States Patent
Tsuruta et al.

(10) Patent No.: US 6,762,780 B2
(45) Date of Patent: Jul. 13, 2004

(54) PRINTING APPARATUS

(75) Inventors: Wataru Tsuruta, Yamanashi (JP); Hiroshi Mochizuki, Yamanashi-ken (JP); Masao Watanabe, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 63 days.

(21) Appl. No.: 10/160,287

(22) Filed: Jun. 4, 2002

(65) Prior Publication Data

US 2002/0186289 A1 Dec. 12, 2002

(30) Foreign Application Priority Data

Jun. 7, 2001 (JP) ..... 2001-172996

(51) Int. Cl.[7] ..... B41J 2/325; B41J 2/315

(52) U.S. Cl. ..... 347/171; 347/217

(58) Field of Search ..... 347/215, 217, 347/218, 219, 171; 101/33; 400/120.01

(56) References Cited

U.S. PATENT DOCUMENTS 6,236,420 B1 * 5/2001 Matsuzaka ..... 347/170
6,476,841 B1 * 11/2002 Miyano ..... 347/213
6,587,135 B1 * 7/2003 Suzuki et al. ..... 347/217
2002/0178939 A1 * 12/2002 Tsuruta et al. ..... 101/33

FOREIGN PATENT DOCUMENTS

| | | | |
|---|---|---|---|
| GB | 2 309 938 | * 8/1997 | ..... B41J/3/407 |
| JP | 08-058124 | 3/1996 | |
| JP | 08-058125 | 3/1996 | |
| JP | 09-131930 | 5/1997 | |
| JP | 10-29331 | 2/1998 | |

* cited by examiner

*Primary Examiner*—K. Feggins
(74) *Attorney, Agent, or Firm*—Kanesaka & Takeuchi

(57) ABSTRACT

A printing apparatus includes an image forming portion for selectively forming images to a card and to an intermediate transfer sheet, and a transfer portion for transferring images formed onto an intermediate transfer medium to a card. The image forming portion and transfer portion are opposingly arranged to a card transport path and are arranged offset along the card transport path. This allows the shared use of members for direct transfer and indirect transfer to enable smooth printing. The apparatus switches between the direct transfer method and the indirect transfer method to print to the card and enables lower costs and improved printing speed.

18 Claims, 6 Drawing Sheets

PRINTING APPARATUS

BACKGROUND OF THE INVENTION

This invention relates to a printing apparatus for printing a variety of information such as images and characters to a recording medium, such as a card, and more particularly to a printing apparatus that is capable of selecting printing methods according to the characteristics of the recording medium or the information that is to be printed.

Conventionally, thermal transfer method printing apparatuses that record desired images and characters by thermally transferring with a thermal head via a thermal transfer film to a recording medium are used to create card shaped recording medium, like credit cards, cash cards, license cards and ID cards. As an example, Japanese disclosure Tokkaihei 9-131930 teaches a direct transfer method printing apparatus that directly transfers images and characters to a recording medium via thermal transfer film. The use of a thermal sublimate ink has the benefit of attaining high quality images because this type of ink is more expressive. However, a receptive layer to receive ink on the surface of a recording medium to which images, etc., are transferred is an essential element to enable this method of printing, so a problem exists in that either the type of recording medium that can be used is limited, or it is necessary to form the aforementioned receptive layer upon the surface of a recording medium.

Generally, cards made of polyvinyl chloride (also known as PVC cards) are widely used as the recording medium because they can receive thermal sublimate ink. However, due to the fact that harmful substances are generated when these cards are burned, there has been consideration given to switching to cards made of polyethylene terephthalate (also known as PET cards). However, PET cards have a crystal-like quality so not only is it difficult to use them for thermal sublimate printing, but embossing them is also difficult. Thus, if it is necessary to emboss the surface of the recording medium, the use of PVC cards is presently unavoidable.

Furthermore, in recent years, there are card shaped media of the type having IC chips or antennae embedded therein such as IC cards, which are being used in a variety of fields. Because of the embedding of such elements into the card, the surface of the card becomes uneven resulting in problems in transferring images.

Japanese disclosure Tokkaihei 8-58124 teaches the technology of an indirect transfer method printing apparatus that transfers an image to an intermediate transfer medium once, then transfers that image again to the recording medium, as a method for overcoming the aforementioned problems. According to this method, it is possible to overcome the problems such as the limitation of recording medium related to the receptive layer or the transferring of images to an uneven surface of the recording medium which had been considered demerits of the direct transfer method. Furthermore, this method has the advantage of being easier to printing to the entire surface of the card shaped recording medium compared to the direct transfer method.

Disclosed in Tokkaihei 8-58125 is a thermal transfer printing apparatus that prints to both the front and back surfaces of a recording paper, configured to transfer ink to an intermediate transfer film using a thermal head and after forming an image, to re-transfer the ink image to a recording paper surface by a heat roller, and configured to transfer ink to the back side of a recording paper with a thermal head that is different from the aforementioned thermal head, the thermal head for transferring ink to the back surface of the recording paper surface interposed by an ink film is opposingly arranged to a heat roller for the retransfer process.

However, running costs for the intermediate transfer method are higher than the direct transfer method because an intermediate transfer medium must be used. Printing also takes longer. Furthermore, depending on the design of the card, even if the entire front surface is required for printing, often times only the back side is used to print precautions for card use, thus there are fewer cases requiring printing over the entire surface. Thus, it can be said that there are merits and demerits for both methods of printing. Furthermore, to print to both front and back surfaces of a recording medium on the same thermal transfer printing apparatus according to the apparatus disclosed in Tokkaihei 8-58125, it is necessary for the transport speed to be different for the recording medium when being processed by the heat roller or the thermal head. When both surfaces of the recording medium are heated, it has been pointed out that the problem of poor peeling of the film occurs as a result of the high temperature of the intermediate transfer film.

Therefore, to handle information relating to printing, such as the surface shape and characteristics of the recording medium including the type of material of the recording medium such as whether it is PVC or PET, embossed, or whether or not it includes an IC element and whether or not it is necessary to print to the entire surface of the recording medium, the printing apparatus is able to select printing methods between the direct transfer method and the indirect transfer method. By sharing portions of the members for the direct transfer method and the intermediate transfer medium, the merits related to both methods of printing were employed thereby allowing for a low cost printing apparatus. This contributed to wide spread use of such printing apparatuses. Also, it is also thought that such apparatuses grew in use partly because of the improvements attained for printing speeds.

An object of the present invention is to provide a low cost printing apparatus that can select the direct transfer method and the indirect transfer method for printing to recording medium and that is not large in overall size.

Still another object of the present invention is to improve printing speed while providing a printing apparatus that increases printing speed when printing with either the direct printing or the indirect printing.

Still another object of the present invention is to provide a printing apparatus that can print high quality images with both the direct transfer method and the indirect transfer method while satisfying expanding demands on printing to recording medium.

SUMMARY OF THE INVENTION

In order to attain the aforementioned objectives, the print apparatus according to the present invention is equipped with at least one printing means for selectively forming an image to a recording medium and to an intermediate transfer medium, a transfer means for transferring the image formed on the aforementioned intermediate transfer medium to the aforementioned recording medium and a recording media transport path for transporting the aforementioned recording medium, the aforementioned printing means and the aforementioned transfer means being opposingly arranged on the aforementioned recording media transport path and are arranged offset along the aforementioned recording media transport path.

The printing apparatus is equipped with a support means to support the aforementioned recording medium or the aforementioned intermediate transfer medium when forming images using the aforementioned first printing means, the support means arranged in a substantially horizontal direction with the aforementioned transfer means along the aforementioned recording media transport path and opposingly arranged to the aforementioned first printing means. The aforementioned first printing means selectively forms images on the first recording medium and the aforementioned intermediate transfer medium, the aforementioned support means supports the aforementioned first recording medium or the aforementioned intermediate transfer medium when forming images using the aforementioned first printing means and the aforementioned transfer means transfers images formed on the aforementioned intermediate transfer medium to the second recording medium.

Also equipped is the second printing means to form images on the aforementioned recording medium. The first printing means and the second printing means are opposingly arranged to the aforementioned recording media transport path. When arranged in that manner, the aforementioned first printing means and the aforementioned second printing means are arranged offset along the aforementioned recording media transport path.

Note that further equipped is the second printing means for forming images on the aforementioned recording medium, the first printing means and the second printing means are arranged in series along the aforementioned recording media transport path and the aforementioned first printing means and second printing means can also be configured to be opposingly arranged to the aforementioned recording media transport path.

Also comprised are the first mode for forming images on the aforementioned recording medium using the aforementioned first printing means and the second mode for forming images on the aforementioned intermediate transfer medium using the aforementioned first printing means and for transferring those images to the aforementioned recording medium using the aforementioned transfer means, and also provided is a mode selection means for selecting the aforementioned first mode and the aforementioned second mode.

There is also comprised a consecutive mode that links the aforementioned first mode and the aforementioned second mode, the aforementioned mode selection means capable of selecting the first mode and the second mode.

It is preferred to equip the apparatus with a recording medium transport speed control means that controls the transport speed of the aforementioned recording medium when forming images thereupon using the aforementioned printing means so that it differs from the transport speed of the aforementioned recording medium when transferring thereto images formed on the aforementioned intermediate transfer medium using the aforementioned transfer means.

Other objectives and features of the present invention shall be clearly explained in a detailed description of the preferred embodiment below based upon the drawings provided.

DETAILED DESCRIPTION OF THE DRAWINGS

FIG. 2A shows the thermal head retracting down, FIG. 2B shows the thermal head advanced upward;

FIG. 3A shows the heat roller retracting down, FIG. 3B shows the heat roller advanced upward;

FIG. 4A is a front view showing a model of the thermal transfer sheet, FIG. 4B is a sectional view showing a model of the intermediate transfer sheet;

DETAILED DESCRIPTION OF THE PREFERRED EMBODIMENTS

The following shall explain the preferred embodiment of the present invention to enable printing with a direct transfer method and indirect transfer method, in reference to the drawings provided.

Figure 1:
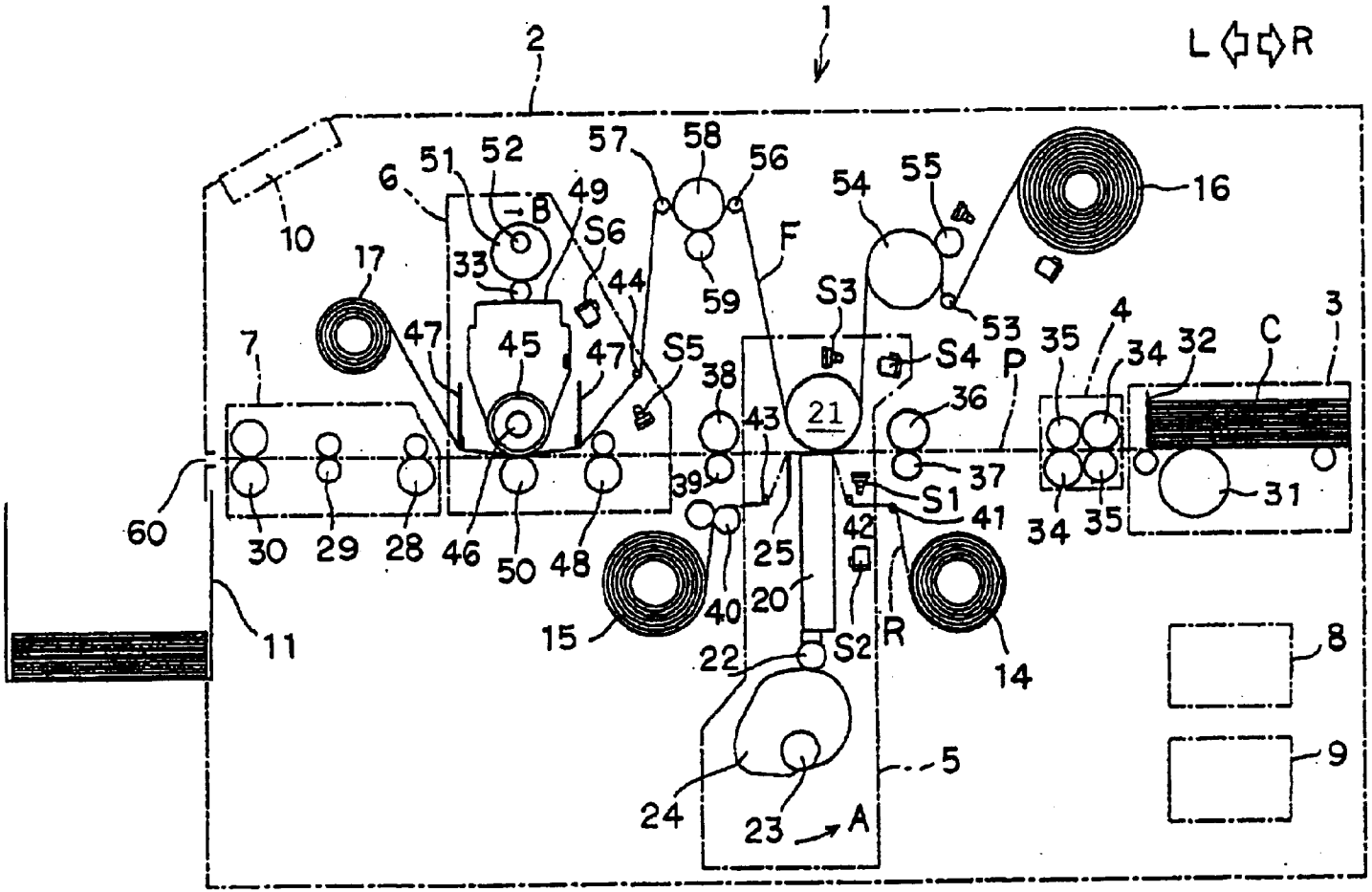
FIG. 1 is a side view showing the general configuration of the printing apparatus according to the embodiment of the present invention.

As can be clearly seen in FIG. 1, the printing apparatus 1 according to the embodiment of the present invention comprises in the housing of the frame 2, the card transport path P which is the card transport path for the card C, which is the recording medium. The card transport path P is arranged substantially horizontally. Along the card transport path P are established in order from the upstream side to the downstream side, the card supply portion 3 that draws out the card C one at a time and sends it to the card transport path P, the cleaner 4 that cleans both surfaces of the card C, the image forming portion 5 that forms images or character information to one side of the card C using a thermal transfer ink or forms images to the intermediate transfer sheet F, the transfer portion 6 that transfers images formed on the intermediate transfer sheet F at the image forming portion 5 to the other side of the card C and the horizontal transport portion 7 that transports the card C in the horizontal direction.

The card supply portion 3 comprises the card stacker to store stacks of a plurality of the card C. The stacker side plate 32 that comprises an opening slot to allow only one of the card C to pass therethrough is arranged in the position facing the card transport path P on the card stacker. To the bottom of the card stacker is pressingly arranged the kick roller 31 to rotatingly feed one at a time the card C positioned at the bottom of the plurality of the card C stored in a stack in the card stacker.

The cleaner 4 comprises the cleaning roller 34, made of a rubber material, the surface thereof applied with an adhesive substance and the pressing roller 35 to press facing each other nipping the card transport path P.

The image forming portion 5 employs the configuration of a thermal transfer printer and comprises the platen roller 21 that supports the card C when printing to a surface thereof and the thermal head 20 retractably arranged to the platen roller 21. The thermal transfer sheet R and the intermediate transfer sheet F are interposed between the platen roller 21 and thermal head 20.

The retracting movement of the thermal head 20 to and from the platen roller 21 is performed by the thermal head sliding drive unit that comprises the holder, not shown in the drawings, that removably supports the thermal head 20, the follower roller 22 that is fastened to the holder, the non-circular thermal head sliding cam 24 that rotates in either direction (the direction of arrow A or the opposite in the drawing) around the cam shaft 23 while following the outer contour of the follower roller 22 and the spring, not shown in the drawings, to press the holder against the thermal head sliding cam 24.

Figure 4A:
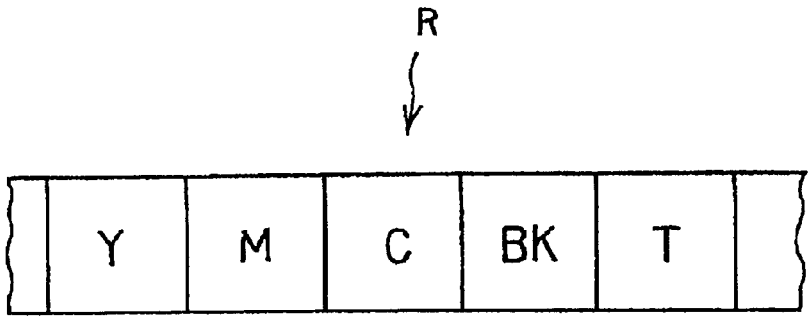
FIG. 4A and FIG. 4B are explanatory drawings of the thermal transfer sheet and intermediate transfer sheet.

As shown in FIG. 4A, the thermal transfer sheet R is affixed with inks of Y (yellow), M (magenta), C (cyan) and Bk (black) in order on the film having widths slightly larger than the length of the card C in the length direction, and a protective layer region T to protect the card C surface formed thereupon by images after the Bk (black) and they are repeated in order along the surface.

FIG. 1 shows the thermal transfer sheet R supplied from the thermal transfer sheet supply portion 14 where the thermal transfer sheet R is wound in a roll, guided by the guide rollers 41, 42 and 43 and the guide plate 25 which is fastened to the holder, not shown in the drawings, while substantially touching the entire surface of the leading edge of the thermal head 20, driven along with the rotational drive of the paired take-up roller 40, to be rolled onto the thermal transfer sheet take-up portion 15. The thermal transfer sheet supply portion 14 and the thermal transfer sheet take-up portion 15 are arranged in positions on both sides of the thermal head 20. Furthermore, to the image forming portion 5, the light emitting element S1 and light receiving element S2 for detecting the mark for positioning thermal transfer sheet R are separated and arranged to traverse facing the thermal transfer sheet R between the guide roller 41 and guide plate 42.

Note that to the drive side roller shaft of the paired take-up rollers 40 is mated a gear, not shown in the drawings, the gear meshing with the gear comprising the clock plate not shown in the drawings on the same shaft. Near the clock plate (not shown) is arranged the unitized transmissive sensor, which also is not shown, to detect the rotation of the clock plate to control the amount of take-up of the thermal transfer sheet R.

Figure 2A:
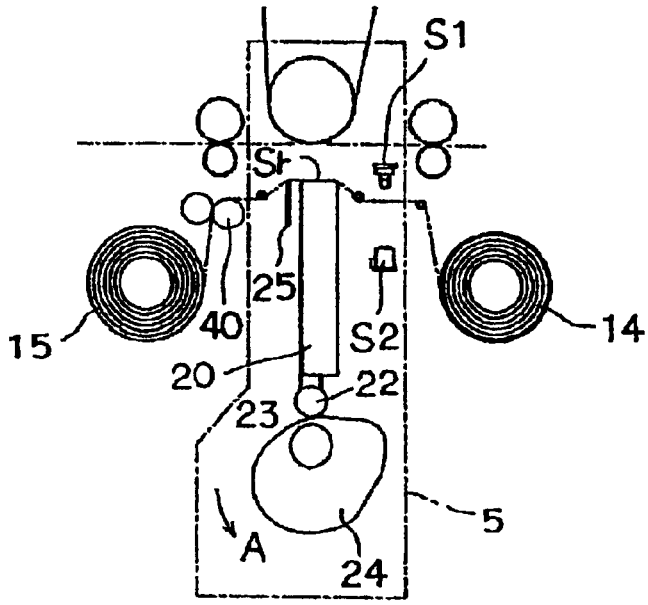
FIG. 2A and FIG. 2B are side views of the image forming portion to explain the action of the sliding drive unit in the printing apparatus according to the present invention.
Figure 2B:
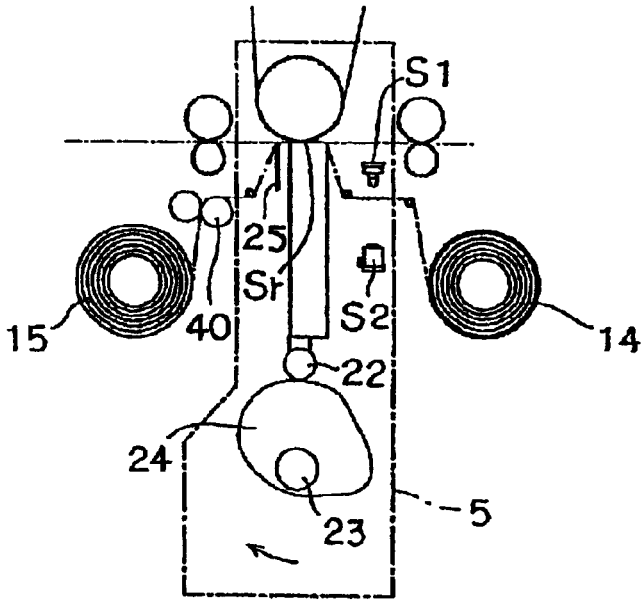

The printing position (heating position) Sr of the thermal head 20 interposed by thermal transfer sheet R toward the card C corresponds to the first card transport path P1 on the outer circumference of the platen roller 21 (see also FIGS. 2A and 2B). On both sides of the image forming portion 5 are arranged the capstan roller 36, the pinch roller 37 paired thereto and pressing against the capstan roller 36 and the paired capstan roller 38 and pinch roller 39 nipping the card transport path P1 and that rotate in synchronization to move the card C in the upstream and the downstream directions (FIG. 1 arrow L and arrow R) with regard to the printing position Sr. These roller pairs are set so the card C transport speed is 28.23 mm/sec when printing one surface of the card C at the printing position Sr using the direct printing method.

Figure 4B:
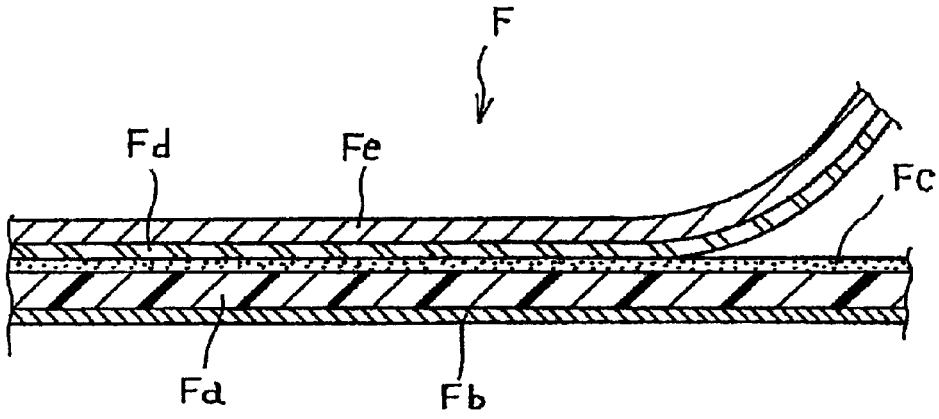

To form images on the card C using the intermediate transfer method, the platen roller 21 is trained with the intermediate transfer sheet F. As shown in FIG. 4B, the intermediate transfer sheet F is formed of the base film Fa, the back surface coating layer Fb formed on the back side of the base film Fa, the receptive layer Fe to receive ink, the overcoat layer Fd to protect the receptive layer Fe surface, the peeling surface Fc to promote the peeling of the overcoat layer Fd and the receptive layer Fe thermally joined, from the base film Fa, starting from the bottom, the back surface coating layer Fb, the base film Fa, the peeling surface Fc, the overcoat layer Fd and the receptive layer Fe are formed in order in layers. The intermediate transfer sheet F is trained with the receptive layer Fe opposing the thermal transfer sheet R and the back coating layer Fb side touching outer circumference of the platen roller 21. Note that to the image forming portion 5, the light emitting element S3 and the light receiving element S4 for detecting the mark for positioning of the intermediate transfer sheet F are arranged separated from but perpendicular to the intermediate transfer sheet F between the platen roller 21 and guide roller 54. This can be seen in FIG. 1.

The transfer portion 6 is arranged downstream of the card transport path P opposing the image forming portion 5. The transfer portion 6 is equipped with the platen roller 50 that supports the card C when transferring from the intermediate transfer sheet F to the card C and the heat roller 45 slidably disposed to the platen roller 50. Built-in to the heat roller 45 is the heating lamp 46 as the heating body to heat the intermediate transfer sheet F. The intermediate transfer sheet F is interposed between the platen roller 50 and heat roller 45.

The retracting movement of the heat roller 45 with regard to the platen roller 50 is performed by the elevator drive unit comprising the holder 49 that removably supports the heat roller 45 built into the holder 49, the follower roller 33 that is fastened to the holder 49, the non-circular heat roller elevator cam 51 that rotates in one direction (the direction of arrow B in FIG. 1) centered on the cam shaft 52 while following the outer contour of the follower roller 33 and the spring, not shown in the drawings, that presses the upper surface of the holder 49 against the heat roller elevator cam 51.

The intermediate transfer sheet F is supplied from the intermediate transfer sheet supply portion 16, the intermediate transfer sheet F being wrapped thereabout, and is guided by the transport roller 54 that accompanies the follower roller 55, the guide roller 53 and platen roller 21, the guide roller 56, the back tension roller 58 that applies a reverse tension to the intermediate transfer sheet F along with the pinch roller 59, the guide rollers 57 and 44 and the guide plate 47 mounted to the frame configuring the transfer portion 6 arranged on both sides of the heat roller 45. When transferring, the card C is interposed between the platen roller 50 and heat roller 45 on second card transport path and the intermediate transfer sheet F is taken up by the intermediate transfer sheet take-up portion 17 that takes up the intermediate transfer sheet F. When transferring to the other side of the card C using the transfer portion 6, the transport speed of the card C is set to 18 mm/sec.

To the back-tension roller 58 shaft is mated the clock plate (not shown in the drawings). The intermediate transfer sheet F is fed forward and in reverse, the back-tension roller 58 rotates in synchronization with the intermediate transfer sheet F. Near the clock plate, not shown in the drawings, is arranged the unitized transmissive sensor, also not shown in the drawings, that detects the rotation amount of the clock plate to control the amount of feeding of the intermediate transfer sheet F.

At the transfer portion 6, the paired rollers 48 that nip and press together over the card transport path P to send the card C downstream, are arranged upstream of the platen roller 50. The paired transport rollers 48 rotatingly drive at a constant speed by the variable synchronization (pulse synchronization) of the pulse motor (another pulse motor, not shown in the drawings, described below) that drives the paired transport rollers 48. Furthermore, to the image forming portion 6, the light emitting element S5 and light receiving element S6 for detecting the mark for positioning of the intermediate transfer sheet F are arranged on either side of the intermediate transfer sheet F between the guide roller 44 and guide plate 47.

The horizontal transport portion 7 comprises the paired transport rollers 28 that transport the card C downstream, the paired follower rollers 29 that have no drive, and the paired discharge rollers 30 that discharge the card C outside of the apparatus. These paired rollers sandwich and pressingly contact the card transport path P. On the line extended to the direction of arrow L on the card transport path P in the frame 2, the discharge outlet 60 is formed to discharge the card C whose printing has been completed to outside of the frame 2. Below the discharge outlet 60 is removably mounted from the frame 2 the stacker 11 for stacking the cards C.

Note that unitized transmissive sensors, not shown in the drawings, that detect the presence of the card C, are arranged between the cleaner 4 and pinch roller 37 on the card transport path P, between the capstan roller 36 and the thermal head 20 on the card transport path P, downstream and near the paired transport rollers 48 on the card transport path P and between the paired discharge rollers 30 and the discharge outlet 60 on the card transport path P.

Also, the printing apparatus 1 comprises in the frame 2 the power supply unit 8 that converts from the commercial alternating current to a drivable/operable direct current to drive all the mechanical and control portions and the control portion 9 to control operations of the entire printing apparatus 1. Furthermore, the printing apparatus 1 comprises a touch panel 10, which is used as the selecting means for an operator to use to input operating instructions to the control portion 9 along with displaying the status of the printing apparatus 1 according to information from the control portion on the upper part of the frame 2.

The control portion 9 is equipped with a CPU block to control the processes of the printing apparatus 1. The CPU block is composed of a CPU that operates under a fast clock speed as its central processing unit, a ROM written with control instructions for the printing apparatus 1 and an internal bus to connect with the RAM that works using the work area on the CPU and these together.

To the CPU block is connected an external bus. To the external bus are connected the touch panel display operation control unit that controls the touch panel 10 display and the operating instructions, the sensor control unit that controls the signals coming from the various sensors, the actuator control unit used as the recording medium transport speed control means that controls the motor driver that outputs drive pulses to each motor, not shown in the drawings, the thermal head control unit that controls the thermal energy of the thermal head 20, the I/O interface therethrough the external computer and printing apparatus 1 communicate and the RAM for storing image information that is to be printed to the card C. The touch panel display and operation control unit, the sensor control unit, the actuator control unit and the thermal head control unit are each connected to the touch panel 10, the sensors including the sensors S1 to S6, the motor driver and to the thermal head 20.

The following shall describe mainly the control unit CPU for the actions of the printing apparatus 1 according to this embodiment. Note that image information received via the external I/O interface from an external computer is stored in the RAM.

The CPU displays the initial screen on the touch panel 10, via the touch panel display operation control unit, and is idle until the operator presses it to select either the first or the second modes of operation. The touch panel 10, at this point displays the first mode button, the second mode button and the third mode button, a mode clear button to clear the selected first to the third mode, the start button to start printing with the mode selected on the printing apparatus 1 and show that the printing apparatus 1 is in standby, read or how many sheets have been processed. The first mode is a direct printing method that forms images onto one side of the card C at the image forming portion 5. The second mode is an indirect printing method that transfers images formed onto the intermediate transfer sheet F at the image forming portion 5 onto the other side of the card C at the transfer portion 6. The third mode is an indirect transfer method to form images onto one side of the card C using the direct printing method by linking the first and second modes, at the image forming portion 5 and to form images on the other side of the card C using the indirect transfer method. Note that in the explanation below, the operator can use the touch panel 10 as the means for selecting either of the first to the third modes, but that it is also perfectly acceptable to select any mode using an instruction signal from an external personal computer.

The CPU takes into the RAM the default values of the selected mode and idles until the start button is pressed, when it is determined that one of the first to third modes has been selected by an operator. Note, that if the mode clear button is pressed before the start button is pressed, the selected mode is cleared and it idles again until one of the modes (the first to the third mode) is selected again. If the start button is pressed, the default values for the mode stored in RAM are read and the printer executes printing according to a program stored in ROM, which corresponds to that mode. The following describes having selected the third mode. The first and the second modes are described below based on the third mode.

First, the CPU activates the card supply portion 3 arranged on the card transport path P and the cleaner 4, and transports the card C from the card supply portion 3 to the direction of the arrow L in FIG. 1. In other words, by rotating the kick roller 31 on the card supply portion 3, the bottom-most blank card C in the card stacker is fed to the card transport path P whereat both sides thereof are cleaned by the cleaning roller 34 on the cleaner 4. The card C is transported, and when the leading edge thereof is detected by the unitized transmissive sensors, not shown in the drawings, arranged between the cleaner 4 and the pinch roller 37, the kick roller 31 on the card supply portion 3 stops rotating and the pulse motor M1, not shown in the drawings, starts rotating to start rotatingly driving the platen roller 21, the capstan roller 36 and the capstan roller 38.

During that time, the thermal head 20 is positioned away from the platen roller 21 (see FIG. 2A) and the thermal transfer sheet R is fed for a determined distance to the printing position Sr, for example at the starting edge of Y (yellow). Such control enables detecting the trailing edge of the Bk (black) portion of the thermal transfer sheet R by the light emitting sensor S2, and detection of the rotation of the clock plate, not shown in the drawings, disposed near the paired take-up rollers 40 by the unitized transmissive sensor, not shown in the drawings, to detect the distance from the trailing edge of the Bk (black) portion having a predetermined width on the thermal transfer sheet R, to the Y (yellow) portion on the thermal transfer sheet R.

The card C, inserted into the image forming portion 5, is transported in the direction of the arrow L, shown in FIG. 1, by the capstan roller 36 and the pinch roller 37 over the first card transport path P1. The CPU transports the card C in the direction of the arrow L a determined number of pulses to the printing starting position, after the unitized sensor arranged between the capstan roller 36 and the thermal head 20 detects the leading edge of the card C, to transport the card C to the printing position Sr. At this point, the other surface of the card C is supported by the platen roller 21 by the rotating action of the thermal head sliding cam 24 toward the direction of the arrow A in FIG. 2A. One surface of the card C is pressed against the thermal head 20 interposed therebetween by the thermal transfer sheet R (see FIG. 2B).

The CPU converts image data for YMC according to the predetermined image information into heat energy, adds a fixed coefficient according to the type of card C and intermediate transfer sheet F and sends that heating information to the thermal head 20. The elements of the thermal head 20 are heated according to this heating information. The pulse motor M1, not shown in the drawings, drivingly rotates the platen roller 21 in the counterclockwise direction. In synchronization to that, the thermal transfer sheet R is taken-up by the thermal transfer sheet take-up portion 15 and the Y (yellow) image is formed (printed) by direct transfer to the card C.

The CPU rotates the thermal head sliding cam 24 in the direction opposite to the arrow A in FIG. 1 when the forming of the image by the Y (yellow) portion is completed and the thermal head 20 is retracted from the card. The CPU starts reverse drive of the pulse motor M1, not shown in the drawings, by rotatingly driving the pinch rollers 38 and 39 after the thermal head 20 is retracted, the card C is transported in the direction of the arrow R in FIG. 1, by the reverse rotation of the platen roller 21, the capstan roller 36, the pinch roller 37, the capstan roller 38 and the pinch roller 39. The CPU stops the reverse rotational drive of the pulse motor M1, not shown in the drawings, after the leading edge of the card C passes the unitized transmissive sensor, not shown in the drawings, arranged between the capstan roller 36 and the thermal head 20, and the card C has been transported for a determined number of pulses. The CPU forward drives the pulse motor M1 to print the next color M (magenta). After the leading edge of the card C is detected by the unitized transmissive sensor, not shown in the drawings, arranged between the capstan roller 36 and the thermal head 20, the CPU transports the card C in the direction of the arrow L in FIG. 1 for a determined number of pulses to the print starting position. During that time, the CPU feeds a minute amount of the thermal transfer sheet R until the leading edge of the next color M (magenta) is positioned at the print starting position Sr. Then, by rotating the thermal head sliding cam 24 again in the direction of the arrow A, the thermal head 20 is pressed against the card C, therebetween interposed by the thermal transfer sheet R. The thermal head 20 forms the image of M (magenta) overlaying the previous color of Y (yellow) on the card C. The CPU, repeats the aforementioned processes in order to overlap images in the YMC inks on the card C. Images are formed using the Bk (black) ink and the transfer of a protective layer to the image forming layer is performed using the protective layer region T. The transport speed of the card C at this time is 28.23 mm/sec, as described above. Note that printing to the back side of the card C often uses the one color of Bk (black). In such cases, images are formed using only Bk (black) according to the same method described above, and image forming using YMC and protective transfers to the image formed using the protective layer region T are not performed.

The CPU rotates the thermal head sliding cam 24 in the direction of opposite to the arrow A in FIG. 1, when the forming of images on one side of the card C has been completed and starts the rotating drive of the pulse motor MI, not shown in the drawings, after retracting the thermal head 20. By rotating the platen roller 21, the capstan roller 36, pinch roller 37, the capstan roller 38 and the pinch roller 39 along with rotating the paired transport rollers 48 using another pulse motor, not shown in the drawings, the card C is transported in the direction of the arrow L in FIG. 1. The transport roller 48 transports the card C at a speed equivalent to that of the capstan roller 38 (the card C transport speed being 28.23 mm/sec.). The CPU stops the drive of the pulse motor MI, not shown in the drawings, and the other pulse motor drives, also not shown in the drawings, after a determined number of pulses of the motor after the leading edge of the card C has passed the unitized transmissive sensor, not shown in the drawings, arranged near the paired transport rollers 48, and positions the card C at a determined position which is the image transfer starting position to the card C at the transfer portion 6.

Next, the CPU heats the thermal transfer sheet R ink with the thermal head 20 and forms an image on the reception layer Fe on the intermediate transfer sheet F. When forming an image, the pulse motor M1, not shown in the drawings, is rotated to rotate the platen roller 21 in the counterclockwise direction while a different pulse motor M2, also not shown in the drawings, is rotated to take-up the intermediate transfer sheet F on the intermediate transfer sheet take-up portion 17 and in synchronization to that, the thermal transfer sheet R is taken up on the thermal transfer sheet take-up portion 15. In other words, it recognizes a mark for positioning established on the intermediate transfer sheet F by monitoring the light emitting sensor S4. It monitors the rotating amount of the clock plate, not shown in the drawings, connected to the back-tension roller 58 that always rotates forward and reverse as one unit to feed or back up the intermediate transfer sheet F to transport the intermediate transfer sheet F for a determined distance to the image print starting position, using the unitized transmissive sensor, not shown in the drawings. The thermal head 20 is positioned away from the platen roller 21 (FIG. 2A) and as described above, the thermal transfer sheet R is fed for a determined distance to the printing position Sr, for example to the starting edge of Y (yellow). The CPU rotates the thermal head sliding cam 24 further in the direction opposite to the arrow A in FIG. 1 when the starting edge of the Y (yellow) portion has reached the printing position Sr and touches the thermal head 20 to the platen roller 21 with the thermal transfer sheet R interposed therebetween. Simultaneously, the pulse motor M1 and the pulse motor M2, not shown in the drawings, to rotate in the feeding direction. This forms the image using the color Y (yellow) on the intermediate transfer sheet F.

The CPU rotates the thermal head sliding cam 24 when the forming of the image on the Y (yellow) portion is completed to the intermediate transfer sheet F, to retract the thermal head 20 from the platen roller 21. By rotating the pulse motor M1 and the pulse motor M2, not shown in the drawings, in the take-up direction, the intermediate transfer sheet supply portion 16 rotates in the clockwise direction and takes up the intermediate transfer sheet F until the positioning mark established thereupon passes the light emitting sensor S4. Next, in the same way as for the Y (yellow) portion, the sensors recognize the mark for positioning established on the intermediate transfer sheet F by monitoring the light emitting sensor S4. The CPU monitors the rotating amount of the clock plate, not shown in the drawings, connected to the back-tension roller 58 that always rotates forward and reverse as one unit to feed or back up the intermediate transfer sheet F to transport the intermediate transfer sheet F for a determined distance to the image print starting position using the unitized transmissive sensor, not shown in the drawings. The thermal transfer sheet R is fed in minute increments until the leading edge of the M (magenta) portion reaches the printing position Sr. In the same manner as was used for the Y (yellow) portion, the thermal head sliding cam 24 rotates again to touch the thermal head 20 to form an image of the M (magenta) portion onto the Y (yellow) portion on the receptive layer Fe on the thermal transfer sheet R. The CPU repeats the above described processes in order to form images in layers using the YMC inks on the intermediate transfer sheet F, and after forming an image using the black (Bk) ink, the thermal head 20 retracts from the platen roller 21.

Note that through the control portion 19 of thermal control unit, the thermal energy applied to the thermal head 20 when forming images on the intermediate transfer sheet F is controlled to be lower than the thermal energy applied to the thermal head 20 when directly transferring to the card C and that the specific heat of the base film of the intermediate transfer sheet F itself is a lower specific heat than the card C. Operations of such thermal energy can be performed by changing coefficients to the aforementioned thermal energy.

Next, the CPU rotates the pulse motors M1 and M2, not shown in the drawings, in the feeding direction to transport the intermediate transfer sheet F to the heat roller 45 separated from the platen roller 50 in advance, according to the amount of rotation of the clock plate, not shown in the drawings, which is connected to the back-tension roller 58 detected by the unitized transmissive sensor S7. Note that by monitoring the light emitting sensor S6 during the transport, it is possible to detect the mark for positioning the intermediate transfer sheet F to reset the amount of transport at this point to improve the accuracy of the transport.

Figure 3A:
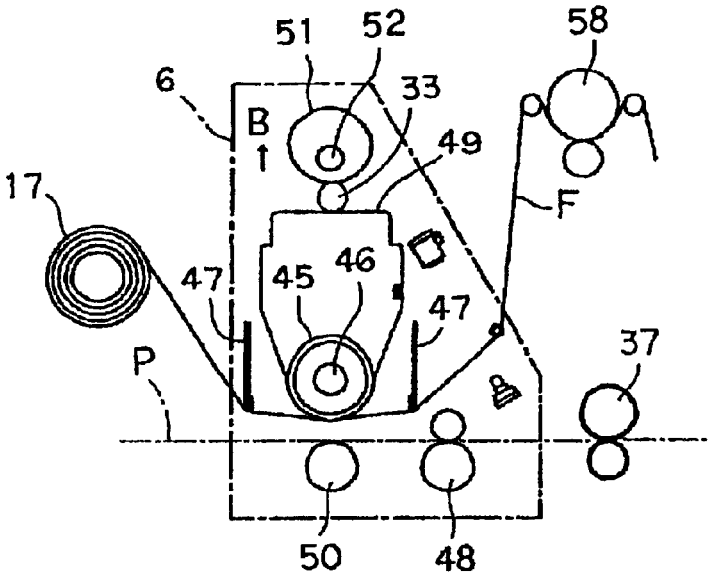
FIG. 3A and FIG. 3B are side views of the transfer portion to explain the action of the elevator drive unit in the printing apparatus according to the present invention.
Figure 3B:
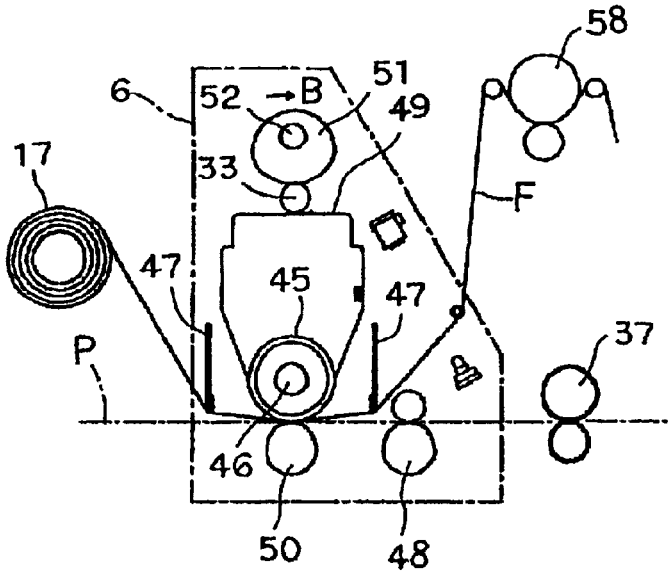

The CPU rotates the heat roller elevator cam 51 in the direction of the arrow B from the state depicted in FIG. 3A, and shifts the heat roller 45 from being separated from the platen roller 50 to touching the platen roller 50, then stops the rotation of the heat roller elevator cam 51 (see FIG. 3B). At this point, the leading edge of the card C touches the heat roller 45, a side of the card C being supported by the platen roller 50 and the intermediate transfer sheet F interposed between the other side of the card C and heat roller 45. Note that the heat lamp 46 inside the heat roller 45 is pre-lit to allow it to reach the determined transfer temperature. The CPU rotatingly drives the pulse motor M2, not shown in the drawings, in the feeding direction. Through this, a side of the card C abuts the heat roller 45, the intermediate transfer sheet F interposed therebetween, and the other side of the card C being supported by the platen roller 50 that rotates in the counterclockwise direction. The card C is transported in the direction of the arrow L in FIG. 1. The peeling layer Fc on the intermediate transfer sheet F is peeled away from the base film Fa by the heat of the heating lamp 46 and the layer Fe formed thereupon with an image and the overcoat layer are transferred to the other side of the card C as a single body. In synchronization to this transfer, the intermediate transfer sheet F is taken up by the intermediate transfer sheet take-up portion 17. The transport speed of the card C at this time is 18.23 mm/sec, as described above.

The CPU stops the rotational drive to the feeding direction of the pulse motor M1 and the pulse motor M2, not shown in the drawings, when the transfer of the intermediate transfer sheet F to the other surface of the card C is completed according to the dimensions of the card C and re-rotates the heat roller elevator cam 51 to retract the heat roller 45 from the platen roller 50. The CPU drives the plurality of paired rollers on the horizontal transport portion 7. The card C is discharged to the stacker 11 passing through the horizontal transport portion 7 by way of the discharge outlet 60. The CPU stops the drive of the roller on the card transport path P after a determined amount of time from when a signal is received from the unitized transmissive sensor, not shown in the drawings, arranged between the discharge portion 30 and the discharge outlet 60 and displays the number of cards for which processing has been completed or that processing is completed on the touch panel.

When the first mode is selected, in the same manner as in the third mode, images are formed on one side of the card C with the layering of the colors of YMC and/or Bk (black). After transferring a protective layer to the image formed surface, using the protective layer region T, the thermal head sliding cam 24 rotates in the direction opposite that of the arrow A in FIG. 1 to retract the thermal head 20 from the card C. The rotating drive of the pulse motor M1, not shown in the drawings, starts to rotate the platen roller 21, capstan roller 36, the pinch roller 37, the capstan roller 38 and the pinch roller 39. Also, the card C is transported in the direction of arrow L in FIG. 1 by the rotation of the paired transport rollers 48 at a speed equivalent to the platen roller 21, the capstan roller 36, the pinch roller 37, the capstan roller 38 and the pinch roller 39 by the other pulse motor, not shown in the drawings. The rotations of the platen roller 21, capstan rollers 36 and 38 stop after a determined number of pulses subsequent to the leading edge of the card C passing the unitized transmissive sensor, not shown in the drawings, arranged near the paired transport rollers 48. The paired transport rollers 48 continue rotating by the other pulse motor, also not shown in the drawings, to continue feeding the card C in the direction of the arrow L in FIG. 1. At the point that the unitized transmissive sensors, not shown in the drawings, established near the paired transport rollers 48, detect the leading edge of the card C, the platen roller 50 starts rotating in the counterclockwise direction, and the plurality of paired rollers on the horizontal transport portion 7 also begin rotating. At this time, the transfer portion 6 is separated from the heat roller 45 and the platen roller 50, as shown in FIG. 3A, and the platen roller 50 rotates counterclockwise to support the transport of the card C. The card C is discharged after directly printing, non-stop to the stacker 11 passing the transfer portion 6, horizontal transport portion 7 by way of the discharge outlet 60.

When the second mode is selected, the pulse motor M1, not shown in the drawings, rotatingly drives to start the rotating drive of the platen roller 21, the capstan roller 36 and the capstan roller 38. The card C inserted into the image forming portion 5 does not stop at the printing position Sr, so the card C is transported in the direction of the arrow L in FIG. 1, the leading edge thereof passing the unitized transmissive sensor, not shown in the drawings, arranged near the paired transport rollers 48. Then after a determined number of pulses, the pulse motor M1 and the other pulse motor, both of which are not shown in the drawings, stop their drive to position the card C at the image transfer starting position at the transfer portion 6. Then, in the same way as described for the third mode, the indirect transfer is performed onto the card C and it is subsequently discharged to the stacker 11.

The following shall describe the actions of the printing apparatus 1 according to this embodiment.

The printing apparatus 1 according to the present embodiment comprises an image forming portion 5 that forms images onto a card C or an intermediate transfer sheet F and a transfer portion 6 to transfer to the card C images formed onto the intermediate transfer sheet F, so it is possible to print with both the direct transfer and indirect transfer methods of printing. Also, the printing apparatus 1 comprises the touch panel 10 for selecting either of the modes from the first mode to the third mode. For that reason, the operator selects between either the direct transfer method and the indirect transfer method to print to the card C according to the material quality thereof, such as it being either a PVC or a PET type card, whether or not it is embossed, the surface shape and characteristics of the card C including the presence of IC elements, and information and a variety of purposes relating to various types of printing such as whether or not printing is to occur over the entire surface of the card C to enable the operator to reduce the running costs associated with printing to the card C.

Still further, with the printing apparatus 1, the images are formed onto the card C and onto the intermediate transfer sheet F using with the single thermal head 20. The platen roller 21 opposingly arranged to the thermal head 20 is used when forming images to the card C and the intermediate transfer sheet F. Therefore, with the printing apparatus 1, there is sharing of the direct transfer method and the indirect transfer method to lower costs without increasing the size of the printing apparatus 1.

On the printing apparatus 1, the actuator control unit in the control unit 9 controls the drive mechanism of the pulse motors so that the transport speed of the card C differs when forming images on the card C at the image forming portion 5 and when transferring images on the other side of the card C at the transfer portion 6, thus preventing decreased peeling characteristics caused by the phenomenon of high temperatures as seen in conventional technology and decreased print quality caused by the differences in characteristics of the target for transfer thereby enabling high quality printing of images regardless of the differences in specific heat of the card C and the intermediate transfer sheet F.

Note that according to the embodiment of this invention, when the third mode is selected, direct printing to one side of the card C is performed first, and later indirect printing to the other side is subsequently performed. However, the opposite procedure, namely that of first performing indirect printing to one side of the card C first, then performing the direct printing to the other side of the card C is also possible. In such a case, it is acceptable to arrange the image forming portion 5 upstream of the transfer portion 6 along the card transport path P and to return and take-up the intermediate transfer sheet F up to the transfer portion 6.

Also, in this embodiment of the present invention, the thermal head 20 is arranged on the lower side and the heat roller 45 is arranged on the upper side with regard to the card transport path P, but it is also perfectly acceptable to arrange the thermal head 20 on the upper side and the heat roller 45 on the lower side with regard to the card transport path P without question that it easily attains the same effect.

The present embodiment of the invention herein describes feeding the card C one at a time from the card supply portion 3 on the card transport path P and then performing direct printing and/or indirect printing, then discharging the card C from the discharge outlet 50. However, it is also possible to form images on the intermediate transfer sheet F at the image forming portion 5, then transport the intermediate transfer sheet F to the transfer portion 6 and to transport the card C to the transfer portion 6 to indirectly transfer image to the other side of the card C already having had images directly transferred to one side at the image forming portion 5 and at the same time feeding a different card C from the card supply portion 3 to the image forming portion 5 to allow direct transfer to one side of a different card C at the image forming portion 5 substantially at the same time as indirect printing to the other side of the card C. To perform such processing, a plurality of the cards (2 cards) exist in the card transport path P, thus shortening the processing time for subsequent cards.

Figure 5:
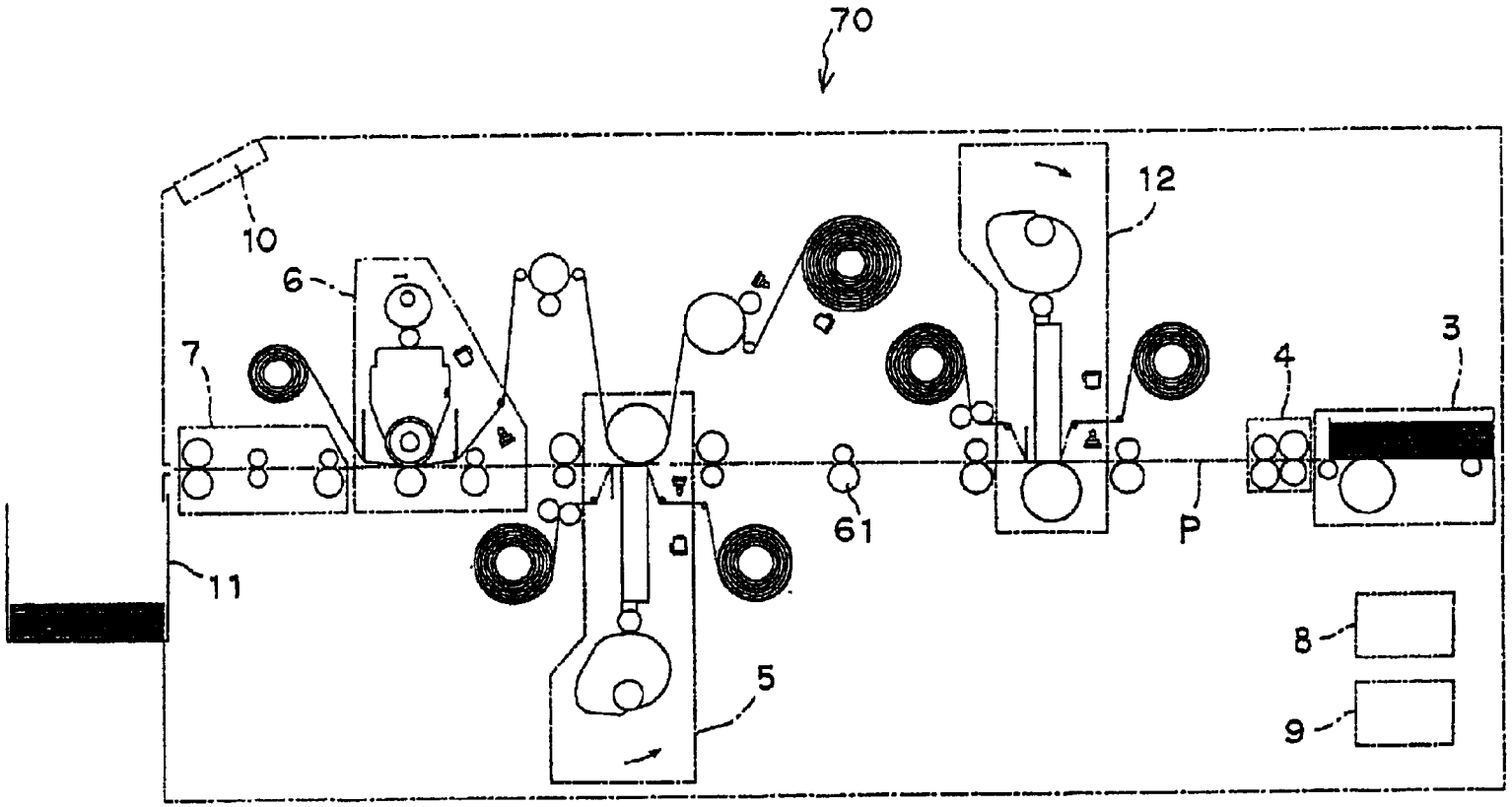
FIG. 5 is a side view of another possible application of the preferred embodiment of the printing apparatus according to the present invention.
Figure 6:
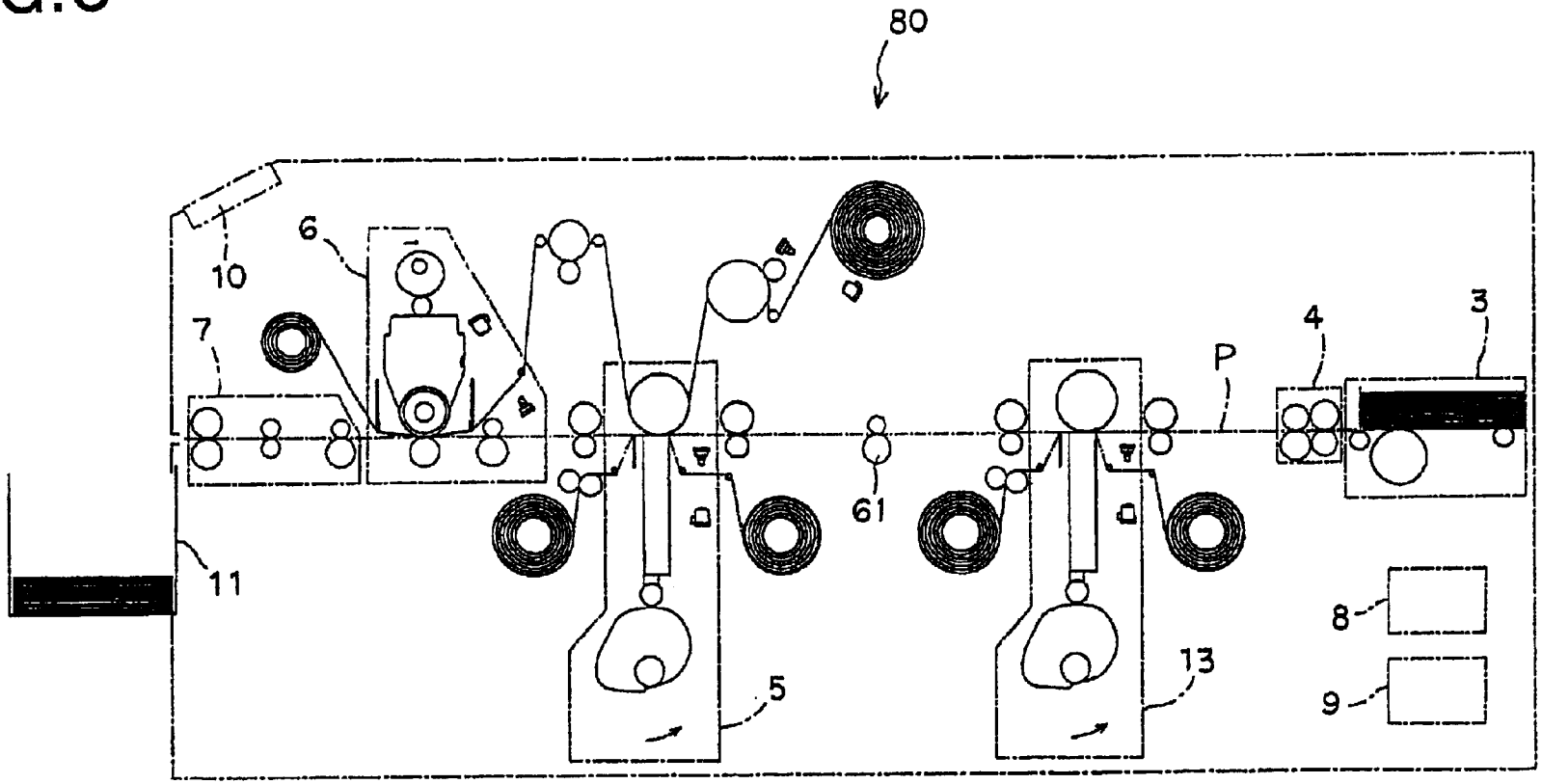
FIG. 6 is a side view of another possible application of the preferred embodiment according to the present invention.

Also, in the printing apparatus 1 of the preferred embodiment of the present invention, there is one image forming portion 5, but as shown in FIG. 5 and FIG. 6, it is also acceptable to establish another image forming portion to form images on the other side of the card C using the direct printing method of another image forming portion 5. In this other image forming portion, the card C is printed directly thereto, so excluding the point that it is unnecessary to train the intermediate transfer sheet F to the platen roller opposingly arranged to the image forming portion, the same structure as the image forming portion can be employed.

The printing apparatus 70, shown in FIG. 5, is an example of opposingly arranging the image forming portion 12 to form images on the other side of the card C using the direct printing method to the image forming portion 5 over the card transport path P and establishing (established offset) upstream of the image forming portion 5 along the card transport path P. With the printing apparatus 70, it is possible to print directly to both sides of the card C and to indirectly print to the other side (the upper side of the card transport path P) so satisfying the printing demands that are comparatively wider than the aforementioned printing apparatus 1, it is possible for a plurality of the cards C to exist simultaneously in the card transport path P and to perform different processes at the image forming portion 12, the image forming portion 5 and the transfer portion 6 thereby enabling higher printing speeds.

The printing apparatus 80, shown in FIG. 6, is an example of serially arranging the image forming portion 13 to form images on the one side of the card C using the direct printing method to the image forming portion 5 along the card transport path P and opposingly arranging the image forming portion 5 and the image forming portion 13 to the transfer portion 6 over the card transport path P. With the printing apparatus 80, it is possible to print directly to one side of the card C and to indirectly print to the other side so compared to the aforementioned printing apparatus 1, it is possible for a plurality of the card C to exist simultaneously in the card transport path P and to perform different processes at the image forming portion 13, the image forming portion 5 and the transfer portion 6 thereby enabling higher printing speeds. Furthermore, when only one card C exists on the card transport path P, it is possible to directly print thereto using the image forming portion 13 when forming an image on the intermediate transfer sheet F at the image forming portion 5 so printing speeds are also improved.

In both FIG. 5 and FIG. 6, the reference number 61 is that for the paired transport rollers, but it is also possible not to arrange such paired transport rollers and to arrange the image forming portion 5 and the image forming portion 12 near each other. By arranging the paired transport rollers 61, it is possible to adjust the transport speed of the card C in the same way as with the aforementioned paired transport rollers 48 when processes differ between the image forming portion 5 and image forming portions 12 and 13. Also, in FIG. 5 and FIG. 6, the image forming portion 12 and image forming portion 13 have been established upstream of the image forming portion 5, but it is also perfectly acceptable to establish them downstream and still attain the same effect.

Thus, as described above, this invention forms images on a recording medium using at least one first printing means and images formed on the intermediate transfer sheet at the first printing means by the transfer means are transferred so while being able to print using directly transfer and indirectly transfer of images to a recording medium, it is also possible to use the first printing means in the direct transfer and in the indirect transfer thereby making the overall size of the apparatus more compact and allowing for it to attain lower costs, the first printing means and the transfer means being opposingly arranged to the recording media transport path, and offset along the recording media transport path, so the recording medium is transported over the recording media transport path to allow direct transfer and/or indirect transfer enabling a smooth printing process.

What we claim is:

1. A printing apparatus comprising:

at least one first printing means for selectively forming images to a recording medium and to an intermediate transfer medium;

transfer means for transferring images formed on said intermediate transfer medium to said recording medium;

recording media transport path for transporting said recording medium, said first printing means and said transfer means being opposingly arranged to said recording medium transport path and arranged offset along said recording media transport path;

transporting means for transporting the recording medium along the recording media transport path; and recording medium transport speed control means for controlling the transporting means, said control means changing transport speeds of said recording medium when forming images thereupon using said printing means and when transferring to said recording medium images formed on said intermediate transfer medium using said transfer means so that said transport speeds are different.

2. The printing apparatus according to claim 1, further comprising support means for supporting said recording medium or said intermediate transfer medium when forming images thereto by said first printing means, said support means being arranged in a substantially horizontal direction with said transfer means along said recording media transport path and being opposingly arranged to said first printing means.

3. The printing apparatus according to claim 2, wherein said first printing means selectively forms images onto a first recording medium and said intermediate transfer medium, said support means supporting said first recording medium or said intermediate transfer medium when forming images using said first printing means, said transfer means transferring images formed on said intermediate transfer medium to a second recording medium.

4. The printing apparatus according to claim 1, further comprising second printing means to form images on said recording medium, said first printing means and said second printing means being opposingly arranged to said recording media transport path.

5. The printing apparatus according to claim 4, wherein said first printing means and said second printing means are arranged offset along said recording media transport path.

6. The printing apparatus according to claim 1, further comprising second printing means for forming images on said recording medium, said first printing means and said second printing means being adjacently arranged along said recording media transport path, said first and said second printing means and said transfer means being opposingly arranged to said recording media transport path.

7. The printing apparatus according to claim 1, further comprising a first mode for forming images onto said recording medium using said first printing means, a second mode for forming images onto said intermediate transfer medium using said first printing means and for transferring said images to said recording medium using said transfer means, and a mode selection means for selecting said first mode or said second mode.

8. The printing apparatus according to claim 7, further comprising a consecutive mode that links said first mode and said second mode, said mode selection means being capable of selecting either said first mode, said second mode or said consecutive mode.

9. The printing apparatus according to claim 1, wherein said recording medium transport speed control means controls the transport speeds such that the transport speed of said recording medium when forming images thereupon using said first printing means is faster that the speed when transferring to said recording medium images formed on said intermediate transfer medium using said transfer means.

10. The printing apparatus according to claim 1, further comprising a thermal control unit for controlling the first printing means, said thermal control unit providing thermal energy to the first printing means differently when the first printing means prints the images on the recording medium and when the first printing means prints the images on the intermediate transfer medium.

11. The printing apparatus according to claim 10, wherein said thermal control unit provides the thermal energy to the first printing means when the first printing means prints the images on the recording medium greater than that when the first printing means prints the images on the intermediate transfer medium.

12. A printing apparatus comprising:

at least one printing means for selectively forming images to a recording medium and to an intermediate transfer medium;

transfer means for transferring images formed on said intermediate transfer medium to said recording medium;

recording media transport path for transporting said recording medium, said printing means and said transfer means being opposingly arranged to said recording medium transport path and arranged offset along said recording media transport path; and thermal control unit for controlling said printing means, said thermal control unit providing thermal energy to the printing means when the printing means prints the images on the recording medium greater than that when the printing means prints the images on the intermediate transfer medium.

13. The printing apparatus according to claim 12, further comprising support means for supporting said recording medium or said intermediate transfer medium when forming images thereto by said printing means, said support means being arranged in a substantially horizontal direction with said transfer means along said recording media transport path and being opposingly arranged to said printing means.

14. The printing apparatus according to claim 13, wherein said printing means selectively forms images onto a first recording medium and said intermediate transfer medium, said support means supporting said first recording medium or said intermediate transfer medium when forming images using said printing means, said transfer means transferring images formed on said intermediate transfer medium to a second recording medium.

15. The printing apparatus according to claim 12, further comprising a first mode for forming images onto said recording medium using said printing means, a second mode for forming images onto said intermediate transfer medium using said printing means and for transferring said images to said recording medium using said transfer means, and a mode selection means for selecting said first mode or said second mode.

16. The printing apparatus according to claim 15, further comprising a consecutive mode that links said first mode arid said second mode, said mode selection means being capable of selecting either said first mode, said second mode or said consecutive mode.

17. The printing apparatus according to claim 12, further comprising recording medium transport speed control means for controlling the transport speeds of said recording medium different when forming images thereupon using said printing means and when transferring to said recording medium images formed onto said intermediate transfer medium using said transfer means.

18. The printing apparatus according to claim 17, wherein said recording medium transport speed control means controls the transport speeds such that the transport speed of said recording medium when forming images thereupon using said printing means is faster that the speed when transferring to said recording medium images formed on said intermediate transfer medium using said transfer means.

* * * * *